US006431128B1

(12) United States Patent
Dabadie

(10) Patent No.: US 6,431,128 B1
(45) Date of Patent: Aug. 13, 2002

(54) CONTROLLED SELF-IGNITION COMBUSTION PROCESS AND ASSOCIATED FOUR-STROKE ENGINE WITH TRANSFER LINES BETWEEN THE EXHAUST LINE AND THE INTAKE LINE

(75) Inventor: Jean-Charles Dabadie, Rueil Malmaison (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/695,990

(22) Filed: Oct. 26, 2000

(30) Foreign Application Priority Data

Oct. 26, 1999 (FR) ..... 99/14022

(51) Int. Cl.[7] ..... F02B 75/20
(52) U.S. Cl. ..... 123/58.8
(58) Field of Search ..... 123/48 B, 58.8

(56) References Cited

U.S. PATENT DOCUMENTS 4,041,910 A * 8/1977 Houseman ..... 123/58.8
4,109,625 A * 8/1978 Kawamura et al. .... 123/568.13
4,156,414 A * 5/1979 Kawamura et al. ..... 123/568.2
4,159,700 A * 7/1979 McCrum ..... 123/58.8
4,175,522 A * 11/1979 Kawamura et al. ..... 123/568.2
4,194,472 A * 3/1980 Amano et al. ..... 123/58.8
4,237,832 A * 12/1980 Hartig et al. ..... 123/58.8
4,276,865 A 7/1981 Hamai
4,506,633 A * 3/1985 Britsch ..... 123/58.8

FOREIGN PATENT DOCUMENTS

| | | |
|---|---|---|
| DE | 19810935 | 9/1999 |
| FR | 2760487 | 11/1998 |
| FR | 2768180 | 12/1999 |
| GB | 26606 | of 1910 |
| WO | WO9934108 | 7/1999 |

* cited by examiner

*Primary Examiner*—Marguerite McMahon
*Assistant Examiner*—Jason Benton
(74) *Attorney, Agent, or Firm*—Antonelli, Terry, Stout & Kraus, LLP

(57) ABSTRACT

The present invention relates to an engine and to a process for controlling the self-ignition combustion of a four-stroke engine comprising several cylinders (1) having each at least one intake means (2) comprising an intake line and at least one exhaust means (3) comprising an exhaust line. During partial load running of the engine, an amount of exhaust gas is taken from the exhaust line of a cylinder and an amount of burnt gas is transferred to the intake line of at least one other cylinder.

In a variant, a transfer line is common to all the cylinders.

15 Claims, 1 Drawing Sheet

CONTROLLED SELF-IGNITION COMBUSTION PROCESS AND ASSOCIATED FOUR-STROKE ENGINE WITH TRANSFER LINES BETWEEN THE EXHAUST LINE AND THE INTAKE LINE

FIELD OF THE INVENTION

The present invention relates to controlled self-ignition four-stroke internal-combustion engines.

BACKGROUND OF THE INVENTION

Controlled self-ignition is a well-known phenomenon in two-stroke engines. This type of combustion has advantages concerning emissions: low hydrocarbon and nitrogen oxides emissions are notably obtained. Furthermore, a remarkable cycle regularity is obtained during self-ignition combustion.

Self-ignition is a phenomenon which allows to initiate the combustion by means of the residual burnt gas remaining in the combustion chamber after combustion.

Self-ignition is achieved by controlling the amount of residual gas and mixing thereof with the fresh gas (not burnt yet). The residual gas (hot burnt gas) initiates combustion of the fresh gas by means of a combination of temperature and of the presence of active species.

In two-stroke engines, the presence of residual gas is <<inherent>> in the combustion. In fact, when the load of the engine decreases, the amount of fresh gas decreases, which leads to an increase in the amount of residual gas (burnt gas from the previous cycle or cycles that has not left the cylinder). Two-stroke engines thus run with an internal circulation (or internal EGR) of the burnt gas at partial load. However, the presence of this internal EGR is not sufficient to obtain the desired self-ignition running. Researchers' work also shows that mixing between this internal EGR and the fresh gas has to be controlled and limited.

The controlled self-ignition technology applied to four-stroke engines is particularly interesting because it allows to operate this type of engine with an extremely diluted mixture, with very low fuel-air ratios and consequently ultra-low nitrogen oxides emissions.

This technology however comes up against a serious technological problem which is that, in order to obtain it without the internal EGR effect of two-stroke engines, it is necessary to either greatly increase the compression ratio of the engine (with knocking problems at high loads), or to greatly warm up the fresh gas admitted (several hundred Celsius degrees), or to combine the two phenomena.

There are solutions allowing to reduce the pressure and temperature level requirements for four-stroke engines, notably by using suitable additives added to the fuel. French patent application FR-2,738,594 illustrates a solution of this type.

For four-stroke engines, it is well-known, notably from international patent application WO-93/16,276, to combine a variable valve timing with a non-return system at the intake in order to decrease the pumping losses at partial load. This solution allows to work with the intake throttle as widely open as possible.

Patent application FR-97/02,822 filed by the claimant describes a self-ignition control in a four-stroke engine. More precisely, this document recommends, at partial load, to minimize mixing of the fresh gas with the burnt gas confined in the combustion chamber by acting on the closing of the exhaust. This solution is thus close to the <<internal>> recirculation technique allowing the gases to be stratified in the combustion chamber.

Patent application FR-97/11,279 filed by the claimant also aims to minimize, at partial load, mixing of the fresh gas with the burnt gas contained in the combustion chamber, in order to control and favour self-ignition combustion. However, this document proposes transferring the burnt gas from the exhaust of a cylinder to the intake of the same cylinder. This solution creates a very high dilution of the recycled burnt gas, by air, before it enters the combustion chamber, which might pose problems.

SUMMARY OF THE INVENTION

The present invention aims to achieve a very simple and therefore reliable controlled self-ignition in multi-cylinder four-stroke engines, easy to implement and favouring maximum stratification of the burnt gas in the combustion chamber. Furthermore, the temperature of the burnt gas is retained or even increased according to the invention, which favours self-combustion.

The object of the present invention is thus a controlled self-ignition combustion process for a four-stroke engine comprising several cylinders having each at least one intake port and at least one exhaust port, the ports and the closing control means being conventional, i.e. as known to the man skilled in the art. The invention can be applied to direct (DIE) or indirect injection engines.

According to the invention, the process consists, during partial load running, in transferring, via a suitable transfer means, exhaust gas from a cylinder, generally during the exhaust stroke, to another cylinder, generally during the intake stroke. The exhaust gas is sent, via a specific valve placed after the exhaust means, to the transfer means. By means of a second valve, the exhaust gas thus transferred reaches the intake line upstream from the intake means. In order to obtain a higher efficiency, it is desirable to have an intake means dedicated to the inflow of the exhaust gas in the cylinder (at least two intake means are then required) in order to decrease mixing between the fresh gas and the burnt gas.

The exhaust gas can thus be recovered from a cylinder at the end of the expansion stroke. It can also be fed into another cylinder at the beginning of the compression stroke.

The process according to the invention also consists in controlling the distribution of the exhaust gas flow between the exhaust system and the transfer means. Furthermore, the process can consist in thermally insulating and/or in warming up the exhaust gas transferred in said suitable transfer means in order to improve self-ignition.

In order to warm up the burnt gas flowing through the transfer means, catalysis means can be arranged in the transfer means. The position of the catalyst is a compromise between a position close to the intake valve of the cylinder, in order to have a higher temperature for the burnt gas as it enters the cylinder, or close to the exhaust valve, in order to facilitate initiation of the catalyst in case of cold start-ups. Besides the fact that the first function of this catalyst is to warm up the burnt gas in order to facilitate controlled self-ignition, in case of cold start-ups, it takes part, as soon as it is initiated, in the reduction of emissions during a stage where the main catalyst of the converter is generally not totally initiated. The catalysis means can comprise a catalyst mass or walls coated with catalyst. In this place, at full load, the catalyst does not receive the burnt gas, it is therefore not likely to undergo premature deterioration and creates no additional pressure drops.

In fact, at full load, the transfer means no longer communicate with the lines associated with the exhaust and intake ports of the cylinders. At full load, the configuration of the engine becomes conventional.

In order to increase the temperature of the exhaust gas at partial load, it is possible to increase the mixture strength of the exhaust gas, notably in the case of a direct injection engine. In this case, fuel injection at the end of the exhaust stroke allows the temperature of the exhaust gas to be increased by means of the reaction in the catalyst. It is conceivable to place a specific fuel injector upstream from the catalysis means.

According to an embodiment of the invention, a common line is used for transfer of the exhaust gas.

According to another embodiment of the invention, transfer of the exhaust gas is performed by means of a series of lines connecting the specific exhaust lines to the specific intake lines two by two.

The present invention also relates to a controlled self-ignition four-stroke internal-combustion engine comprising several cylinders having each at least one intake port and at least one exhaust port.

According to the invention, each cylinder also comprises a specific means allowing passage of the exhaust gas from the exhaust of a cylinder, generally in the exhaust stroke, to at least one other cylinder, generally in the intake stroke, as well as an associated transfer means, transfer taking place during partial load running.

A means intended for thermal insulation and/or heating of the transfer means can also be provided without departing from the scope of the invention.

The engine also advantageously comprises a means intended for distribution of the exhaust gas between the exhaust system and the transfer means, at partial load.

In addition to the specific valve for diverting (totally or partially) the exhaust gas towards the transfer means, the exhaust gas distribution means can comprise a throttling means arranged close to the exhaust means.

According to an embodiment, said transfer means comprises a common line.

According to another embodiment of the invention, the transfer means comprises a series of lines connecting the specific exhaust lines and valves to the specific intake lines and valves two by two.

BRIEF DESCRIPTION OF THE DRAWINGS

Other features, details and advantages of the present invention will be clear from reading the description hereafter, given by way of non limitative example, with reference to the accompanying drawings wherein.

DETAILED DESCRIPTION

Figure 1:
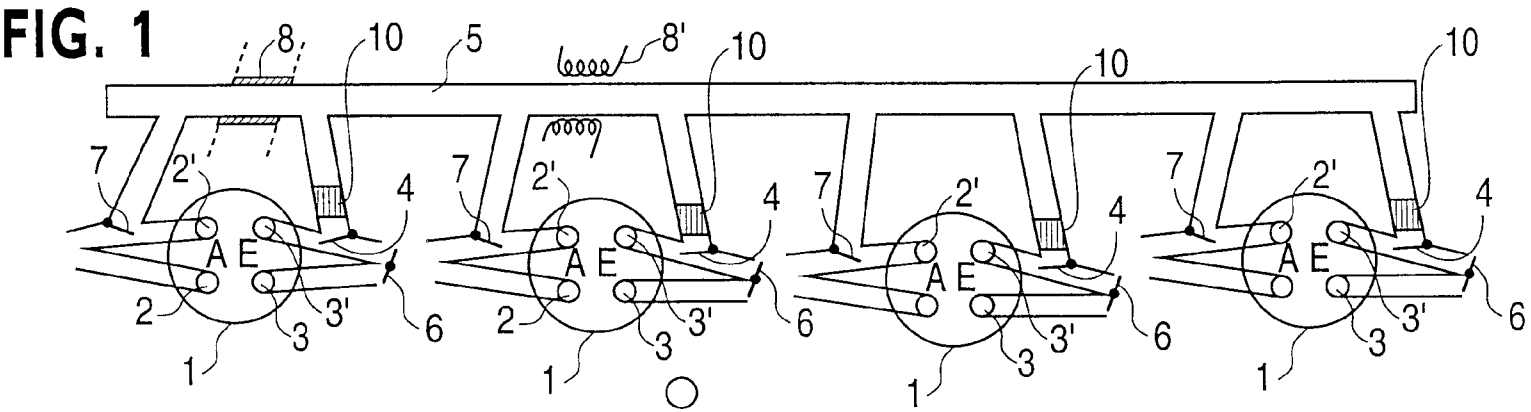
FIG. 1 is a diagrammatic cross-section of an embodiment of the invention.

FIG. 1 illustrates the case of an engine with four cylinders 1. The invention actually applies to any engine comprising at least two cylinders. Letter A represents the intake in a cylinder, letter E the exhaust in the same cylinder.

Each cylinder 1 comprises at least one intake port 2 for a feed. The present invention preferably comprises two intake ports (as shown in the figures). A feed intake means is understood to be here an intake port with which a valve is associated and the line associated with this port. The same definition applies for the term exhaust means.

Each cylinder also comprises an exhaust port 3 conventionally equipped with an associated line and an associated valve.

Furthermore, each cylinder 1 comprises distribution means of valve 4 type, arranged in the exhaust line, of course downstream from the exhaust port. This valve, or equivalent device, allows the burnt gas flowing out of the exhaust port to enter a transfer means 5. In this variant, transfer means 5 is a line that communicates with all the exhaust lines of the cylinders and with all the intake lines. These distribution means allow to control the gas transfer rate between the exhausts and the intakes. At full load, these valves 4 close communication with line 5.

Each cylinder 1 also comprises a valve 7 arranged in the intake, close to intake port 2. It allows the burnt gas to flow from transfer means 5 to cylinder 1 via distribution valve 7 and intake port 2. At full load, these valves 7 are preferably closed.

In each cylinder, a throttling means 6 is arranged in the vicinity of exhaust means 3. A suitable coordinated control means controls the opening of each throttling means 4, 6, 7, and allows to adjust and to distribute the flow of gas between the conventional exhaust and transfer means 5.

Throttling means 6 may not be provided without departing from the scope of the invention.

At partial load, exhaust gas is transferred from a cylinder, generally in the exhaust stroke, to another cylinder, generally in the intake stroke.

The table hereunder illustrates the transfers thus achieved during a cycle, for a four-cylinder engine.

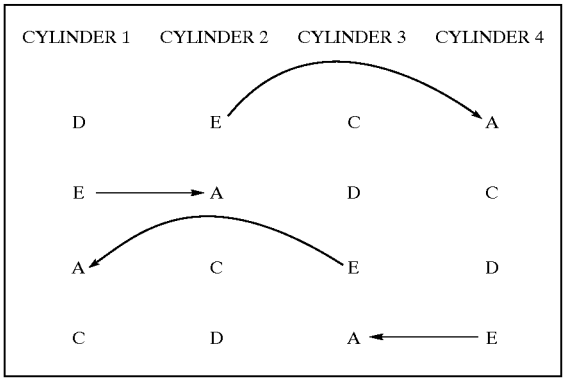

D = expansion; E = exhaust; A = intake; C = compression.

The present invention can use a standard valve gear for opening all the exhaust and intake valves. In this case, at partial loads, the burnt gas and the fresh gas will enter the cylinder together during the intake stroke.

In cases where a known variable valve opening system is available, several strategies can be efficiently used with the present invention:

For the exhaust, in the case of at least two exhaust means (3 and 3'), port 3 intended for the fresh gas can be slightly open at the beginning of the exhaust stroke and port 3', associated with valve 4, normally open, then forces the burnt gas to flow into transfer means 5. This strategy allows to send a larger amount of burnt gas into transfer means 5 and therefore into the other cylinder during the intake stroke. By slightly open, it is meant that one acts on the valve lift height or on the valve lift time, or on both. In this case, throttling means 6 is not necessary. Opening of port 3' can also start and/or take place during the end of the expansion cycle so as to recover very hot burnt gases under pressure. This can also be used for quickly warming up catalyst 10 during cold start-ups.

For the intake, in the case of at least 2 intake means, port 2 can be open at the beginning of the intake stroke and quickly closed again. Port 2' is then open at the end of the intake stroke, thus limiting overlap of valves 2 and 2' so as to limit mixing of the burnt gas with the fresh gas. This configuration allows, with a suitable exhaust valve management strategy, to increase the pressure in the cylinder by forcing the burnt gas to enter after the inflow of the fresh gas feed. The burnt gas inflow can also end at the beginning of the compression cycle in order to increase the amount of burnt gas (if the pressure available in the transfer means allows it).

Another possibility consists in first flowing the burnt gas into the cylinder through port 2', then in flowing the feed therein through port 2, with a limited valve overlap in order to limit mixing of the burnt gas with the fresh gas. The fresh gas can be compressed, by a compressor for example, without departing from the scope of the present invention.

According to an embodiment of the invention, illustrated in FIG. 1, the transfer means comprises a common line with accesses to all the specific valves 4 and 7.

Figure 2:
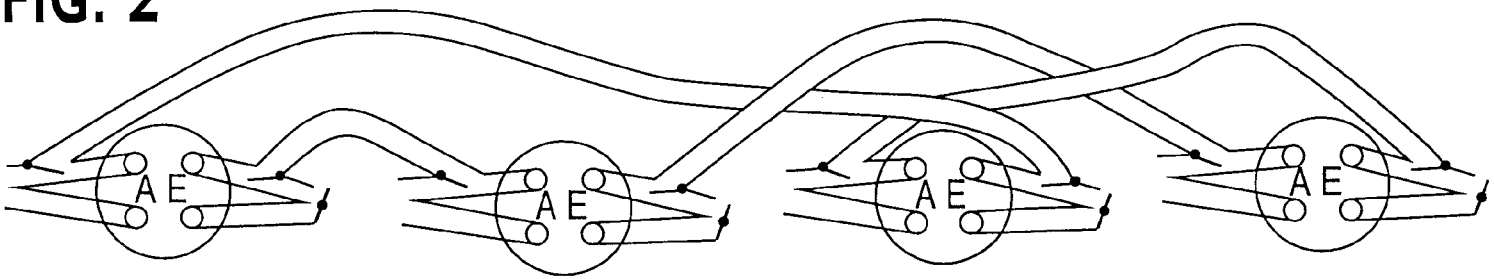
FIG. 2 is a diagrammatic cross-section of another embodiment of the invention.

It is also conceivable, without departing from the scope of the invention, to provide a transfer means such as a series of lines connecting the specific exhaust lines and valves to the specific intake lines and valves two by two, which allows for example, for a four-cylinder engine, to have transfers according to the table above as illustrated by FIG. 2.

Transfer line or lines 5 can advantageously be thermally insulated, by means of a ceramic 8 for example. It can also be heated by specific means 8'. The gas passing through a transfer line 5 thus do not lose or can even gain calories when reaching the cylinder. Self-ignition is thus improved since it is known that the temperature of the recycled gas is an important parameter favouring self-ignition. A catalyst 10 can also be used in order to heat the burnt gas and, at the same time, to advantageously decrease the amount of pollutants present in the burnt gas passing through transfer means 5.

Figure 3:
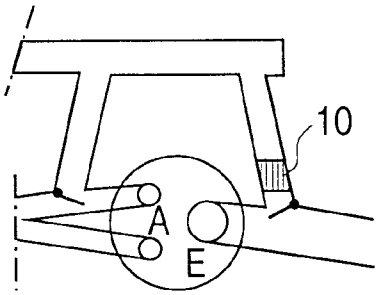
FIG. 3 shows a variant for the previous two embodiments.

FIG. 3 shows a variant where the exhaust only comprises one port. It is clear that the intake means and the exhaust means are not limited to a double exhaust and a double intake.

The present invention has the advantage of not requiring specific transfer ports since it uses the conventional intake and exhaust lines of the four-stroke engine considered.

I claim:

1. A process intended for self-ignition combustion control of a four-stroke engine comprising several cylinders (1) having each at least one intake means (2) comprising an intake line and at least one exhaust means (3) comprising an exhaust line, characterized in that, during partial load running of said engine, an amount of exhaust gas is taken from the exhaust line of a cylinder and an amount of burnt gas is transferred to the intake line of at least one other cylinder.

2. A process as claimed in claim 1, wherein the exhaust gas transferred is thermally insulated and/or heated.

3. A process as claimed in claim 2, wherein the gas is heated by catalysis in the transfer lines.

4. A process as claimed in claim 1, wherein the transferred gas flow is controlled.

5. A process as claimed in claim 1, wherein a common line (5) is used for transfer of the exhaust gas.

6. A process as claimed in claim 1, wherein, at full and high loads, no exhaust gas is taken or transferred.

7. A process as claimed in claim 1, wherein a series of lines connecting the specific exhaust lines to the specific intake lines two by two is used for transfer of the exhaust gas.

8. A controlled self-ignition four-stroke internal-combustion engine comprising several cylinders (1) having each at least one intake means (2) comprising an intake line and at least one exhaust means (3) comprising an exhaust line, characterized in that each cylinder (1) comprises transfer means (5) for transferring the exhaust gas from said exhaust line of a cylinder to an intake line of at least one other cylinder.

9. An internal-combustion engine as claimed in claim 8, wherein the transfer means also comprise a means intended for thermal insulation (8) and/or heating (8') of said transferred gas.

10. An internal-combustion engine as claimed in claim 8, wherein said exhaust means (3) comprises a control means (4) for controlling communication between the exhaust line and line (5) of the transfer means.

11. An internal-combustion engine as claimed in claim 10, wherein said intake means (2) comprises a control means (7) for controlling communication between the intake line and line (5) of the transfer means.

12. An internal-combustion engine as claimed in claim 8, wherein said transfer means comprises a common line (5) communicating with the intake and exhaust lines of each cylinder.

13. An internal-combustion engine as claimed in claim 8, wherein said transfer means comprise catalysis means (10).

14. An internal-combustion engine as claimed in claim 8, wherein said transfer means comprise a series of lines connecting the specific exhaust valves to the specific intake valves two by two.

15. An internal-combustion engine as claimed in claim 8, characterized in that it comprises only one exhaust port.

* * * * *